US006931142B2

(12) United States Patent
Fushimi

(10) Patent No.: US 6,931,142 B2
(45) Date of Patent: Aug. 16, 2005

(54) INSERT EARPHONE

(75) Inventor: Isao Fushimi, Shizuoka (JP)

(73) Assignee: Star Micronics Co., Ltd., Shizuoka (JP)

( * ) Notice: Subject to any disclaimer, the term of this patent is extended or adjusted under 35 U.S.C. 154(b) by 237 days.

(21) Appl. No.: 10/281,228

(22) Filed: Oct. 28, 2002

(65) Prior Publication Data

US 2003/0081805 A1 May 1, 2003

(30) Foreign Application Priority Data

Oct. 31, 2001 (JP) ..... 2001-335894

(51) Int. Cl.[7] ..... H04R 25/00
(52) U.S. Cl. ..... 381/325; 381/380; 181/130
(58) Field of Search ..... 381/309, 322, 381/324–325, 328, 380, 370, 327, 330, 382; 181/129–131, 135; 379/430

(56) References Cited

U.S. PATENT DOCUMENTS

RE38,351 E * 12/2003 Iseberg et al. ..... 381/380

* cited by examiner

*Primary Examiner*—Suhan Ni
(74) *Attorney, Agent, or Firm*—Sughrue Mion, PLLC

(57) ABSTRACT

An insert earphone which prevents a sound leakage and improves wearing comfort. An ear chip has a barrel portion and first and second annular flange portions having the shape of a parabola spreading from the top toward the middle and from the middle toward the base of the barrel portion respectively. The first annular flange portion has a smaller outer diameter than the second annular flange portion. The first annular flange portion has almost even thickness from the inner circumference to the outer circumference, and has the inner circumference neighborhood substantially formed in the shape of a sliced doughnut.

4 Claims, 4 Drawing Sheets

INSERT EARPHONE

BACKGROUND OF THE INVENTION

1. Field of the Invention

The present invention relates to an insert earphone, particularly to a structure of an ear chip thereof.

2. Description of the Related Art

An insert earphone conventionally comprises a receiver unit having a sound passage tube, and an ear chip attached to the receiver unit. The insert earphone is used in state where the ear chip is inserted into an external auditory meatus.

The ear chip of the insert earphone comprises a barrel portion and an annular flange portion. The barrel portion defines a sound passage which communicates to a sound passage of the sound passage tube of the receiver unit. The annular flange portion has the shape of a parabola spreading from the top end of the barrel portion toward the base end thereof. When the ear chip is inserted into the external auditory meatus, the insert earphone is supported by the annular flange portion. The annular flange portion abuts on a wall face of the external auditory meatus to prevent a sound from leaking.

In order to produce a stable sound quality in this type of earphone, it is essential that the shape of the sound passage is maintained when the ear chip is inserted into the external auditory meatus. Therefore, the barrel portion of the ear chip is made relatively thick to obtain sufficient rigidity. The annular flange portion is brought into close contact with the wall face of the external auditory meatus only by the distortion of the annular flange portion.

The ear chip may have a dual structure for the annular flange portion. One annular flange portion has a supporting function of the insert earphone, the other annular flange portion has an contacting function with the wall face of the external auditory meatus.

An insert earphone of this type is shown in FIG. 4. An ear chip 114 of an insert earphone 110 comprises a barrel portion 114A, a first annular flange portion 114B and a second annular flange portion 114C. The first annular flange portion 114B has the shape of a parabola spreading from the top end of the barrel portion 114A toward the middle thereof. The second annular flange portion 114C has the shape of a parabola spreading from the middle portion of the barrel portion 114A toward the base end thereof. The first annular flange portion 114B having a smaller outer diameter compared with the second annular flange portion comes into close contact with the wall face 2*a* at a depth region of the external auditory meatus 2 where improved acoustic characteristics (sufficient sound pressure) is available. Since the second annular flange portion 114C comes into contact with the wall face 2*a* at an entrance region of the external auditory meatus 2, the user do not feel uncomfortable by the second annular flange portion 114C in fitting the insert earphone 110. The insert earphone 110 is supported by the second annular flange portion 114C.

Such conventional insert earphone with a dual flange structure, however, has a disadvantage in that every part of periphery of the first annular flange portion 114B unevenly contacts with the wall face 2*a* since the external auditory meatus 2 extends in not a simple cylindrical shape but a complex curved shape. Since the first annular flange portion 114B is thick at the inner circumference neighborhood 114Ba like in the insert earphone with a single flange structure, the inner circumference neighborhood 114Ba is hardly distorted. Therefore, only the outer circumference neighborhood 114Bb is distorted. It likely causes a lack of pressing force against the wall face 2*a* of the external auditory meatus 2 by the first annular flange portion 114B.

Therefore, the ear chip 114 does not come into close contact with the external auditory meatus 2, causing a sound leakage.

In case where the ear chip 114 is inserted farther depth region of the ear to make the ear chip 114 more closely contact with the wall face 2*a*, the ear chip 114 reaches a first curved portion 2*b* of the external auditory meatus and the top end of a sound passage 114*a* in the ear chip 114 is clogged by the first curved portion 2*b*.

On the contrary, the wall face 2*a* of the external auditory meatus 2 is pressed partially strongly by the outer circumference neighborhood 114Bb of the first annular flange portion 114B, the user feel uncomfortable in wearing the ear chip for a long time.

SUMMARY OF THE INVENTION

An object of the present invention is to provide an insert earphone which effectively prevents a sound leakage and improves comfort in wearing the insert earphone.

The insert earphone of the present invention achieves the object by providing a first annular flange portion of an improved structure.

According to an aspect of the present invention, there is provided an insert earphone adapted to be inserted into an external auditory meatus comprising:

a receiver unit having a sound passage tube;

an ear chip attached to the receiver unit and comprising a barrel portion for defining a sound passage communicating to a sound passage of the sound passage tube of the receiver unit, a first annular flange portion having the shape of a parabola spreading from the top end of the barrel portion toward the middle thereof, and a second annular flange portion having the shape of a parabola spreading from the middle of the barrel portion toward the base end thereof; and the first annular flange portion having a smaller outer diameter compared with the second annular flange portion, wherein the first annular flange portion has almost even thickness from the inner circumference thereof to the outer circumference thereof, and the first annular flange portion has an inner circumference neighborhood substantially formed in the shape of a sliced doughnut.

The ear chip is not limited to the one as herein described. As far as it has first and second annular flange portions, any type of the ear chip is applicable to the present invention. The ear chip may have additional annular flange portions other than the first and second annular flange portions.

As far as the first annular flange portion has almost even thickness from the inner circumference thereof to the outer circumference thereof, the thickness dimension is not limited to a specific value.

The shape of a sliced doughnut is formed by rotating the shape of a circular arc at the section taken along a plane containing the central axis of the barrel portion.

The insert earphone of the present invention has the following advantages.

When the ear chip is inserted into the external auditory meatus, the first annular flange portion, particularly an outer circumference neighborhood thereof is partially brought into contact with the wall face and receives a reaction force there from. Since the first annular flange portion has almost even thickness from the inner circumference to the outer circumference, the inner circumference neighborhood of a smaller diameter is subject to a relatively higher stress. Therefore, the inner circumference neighborhood of the first annular flange portion is firstly distorted. Since the inner circumference neighborhood is substantially formed in a sliced doughnut shape, it is distorted by changing the radius of curvature for every circumferential part of the circular arc at cross section. Thereby, the outer circumference neighborhood is rotated while the original shape thereof is substantially maintained. The opposite side of the outer circumference neighborhood, which is opposed to the side firstly hit against the wall face, hits the wall face as the outer circumference neighborhood is rotated, so that this opposite side is distorted to be pressed against the wall face. If there is a difference in the pressing force against the wall face for every part of the outer circumference neighborhood, the pressing force is averaged due to distortion of the inner circumference neighborhood. Thereby, the first annular flange portion is always in contact with the wall face of the external auditory meatus at a substantially uniform pressing force over the entire periphery.

Therefore, the first annular flange portion is in closely and reliably contact with the wall face of the external auditory meatus, effectively preventing a sound leakage. The outer circumference neighborhood of the first annular flange portion is in contact with the wall face of the external auditory meatus at substantially uniform pressing force over the entire periphery. It assures sufficient contacting function even if the pressing force is set at a small value. Accordingly, the first annular flange portion does not partially strongly press the wall face of the external auditory meatus, thereby increasing comfort while wearing the ear chip.

According to the insert earphone of the present invention, a sound leakage is effectively prevented and comfort in wearing the ear chip is increased.

Since the first annular flange portion is in closely contact with the wall face of the external auditory meatus to successfully prevent a sound leakage, the second annular flange portion can be dedicated to the supporting function of the insert earphone Assigning different functions to the separate flange portions maximizes acoustic performance of the insert earphone.

As above described, sufficient contacting function is assured even if the pressing force of the first annular flange portion against the wall face of the external auditory meatus is set at a small value, thereby the first annular flange portion can be made thinner. However, if it is too thin, the outer circumference neighborhood is difficult to maintain the original shape thereof when rotated. From this point of view, the thickness of the first annular flange portion is preferably set to be from 0.3 mm to 0.6 mm.

As above described, the inner circumference neighborhood of the first annular flange portion is substantially formed in a sliced doughnut shape. The radius of curvature of the outer surface of the inner circumference neighborhood is preferably set to be from 1.0 mm to 1.5 mm. This enables the outer circumference neighborhood to maintain the original shape thereof in rotation due to distortion of the inner circumference neighborhood. The "radius of curvature" as used herein means the radius of curvature along the section taken along a plane containing the central axis of the barrel portion.

DETAILED DESCRIPTION OF THE PREFFERED EMBODIMENTS

The present invention will be described below with reference to the accompanying drawings.

Figure 1:
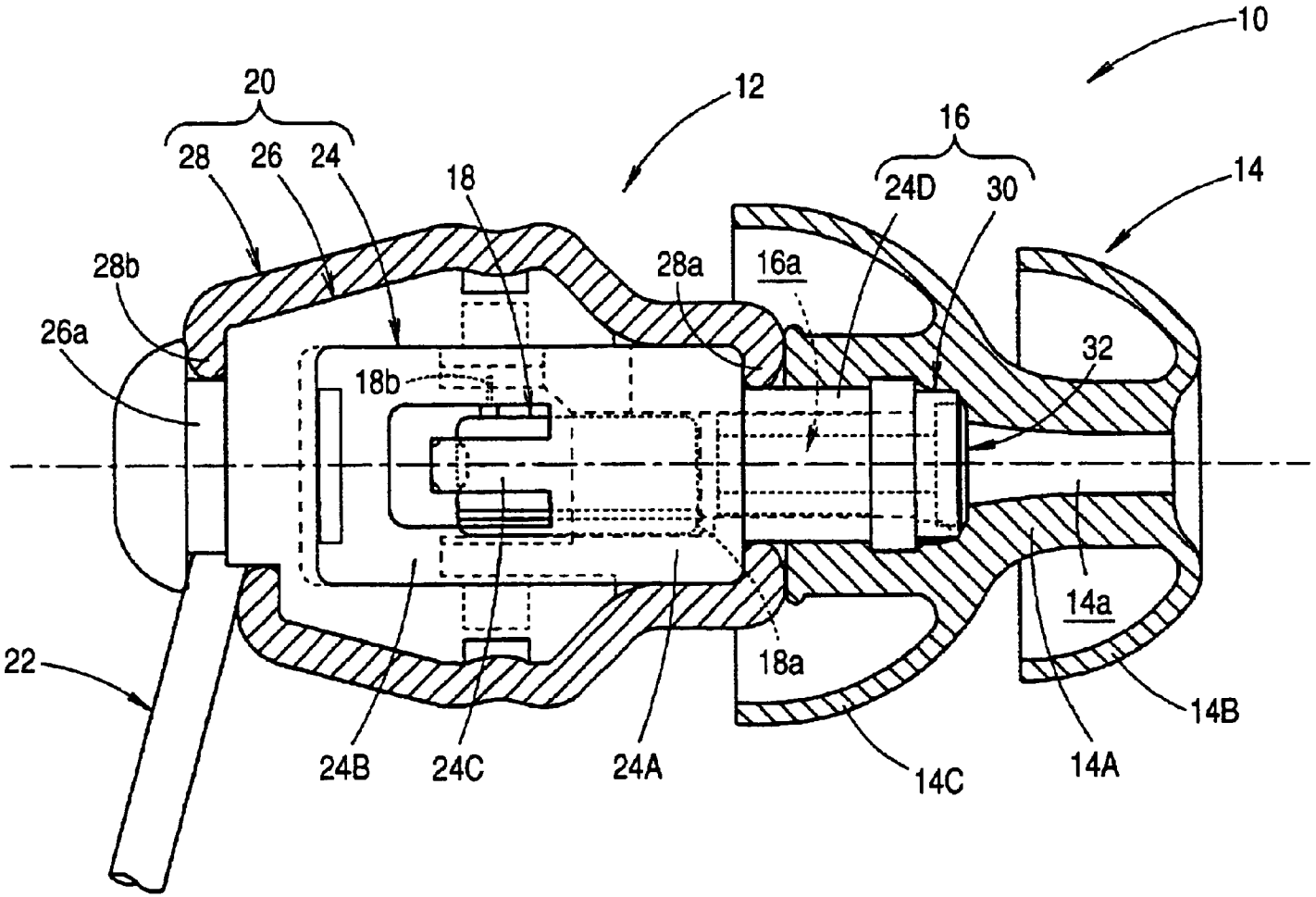
FIG. 1 is a partially sectional side view of an insert earphone of the present invention.

FIG. 1 is a partially sectional side view of an insert earphone 10 of the present invention.

Figure 2:
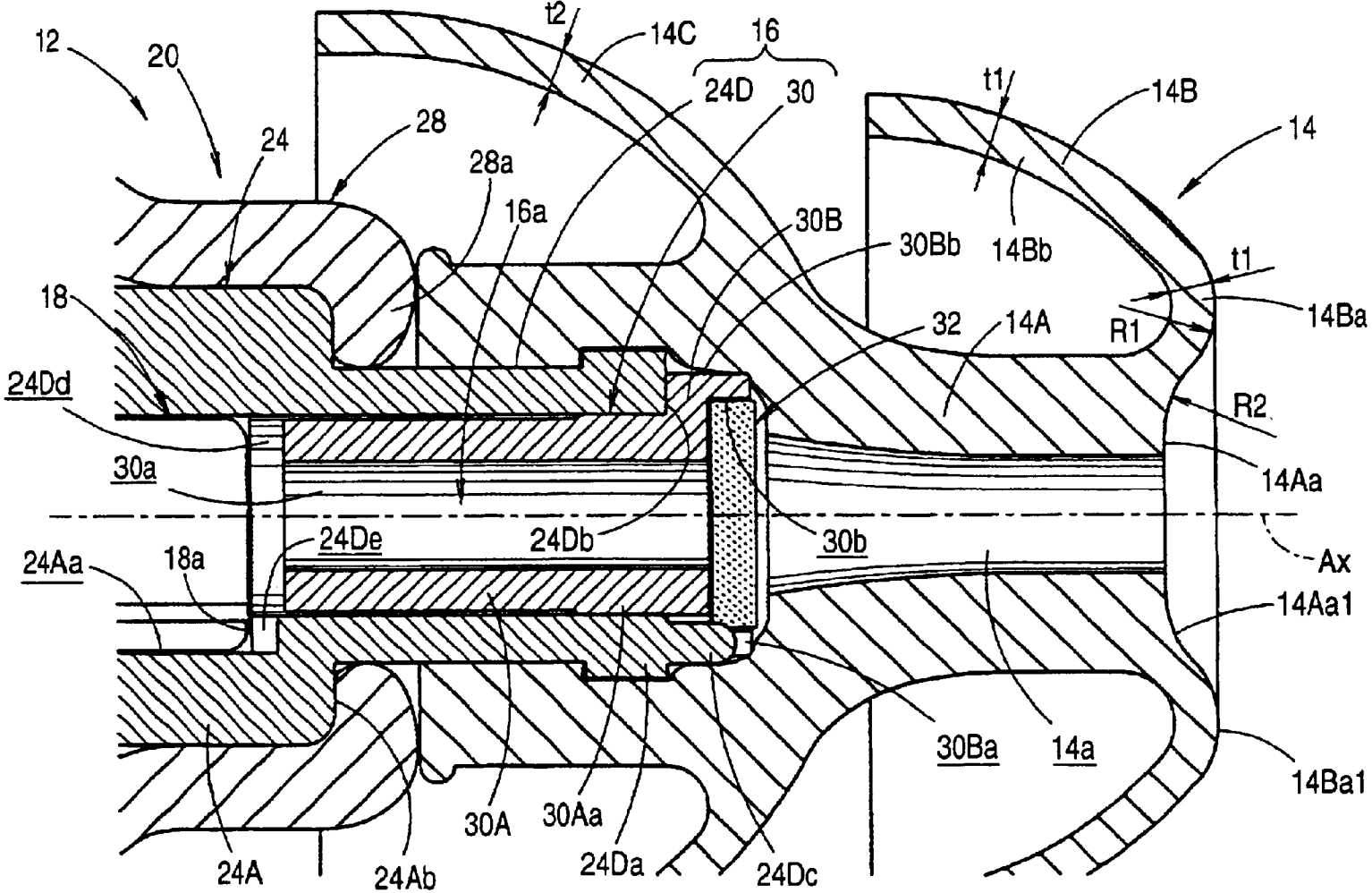
FIG. 2 is a partial side sectional view of the insert earphone.

FIG. 2 is a partial side sectional view of the insert earphone 10.

As shown in these drawings, the insert earphone 10 comprises a receiver unit 12 and an ear chip 14. The receiver unit 12 has a sound passage tube 16 on a front end portion thereof (right end portion in FIG. 1). The ear chip 14 is fitted to the sound passage tube 16. The insert earphone 10 is used in state where the ear chip 14 is inserted into an external auditory meatus.

The receiver unit 12 comprises a receiver main body 18, a housing 20 accommodating the receiver main body 18, and a cord 22 connected to the receiver main body 18.

The receiver main body 18 comprises an electromagnetic receiver of a balance armature type which has substantially a rectangular parallelepiped outer shape. The receiver main body 18 has a sound release hole 18*a* formed at a lower part of the front end face thereof and a terminal 18*b* disposed on an upper face in the vicinity of a rear end thereof. The receiver main body 18 radiates a sound wave through the sound release hole 18*a* in accordance with a signal current transmitted from the terminal 18*b* via the cord 22.

The housing 20 comprises a frame 24 for containing the receiver main body 18, a cord fixing block 26 securely fitted to the frame 24 from the rear side while an end of the cord 22 connected thereto, and an outer covering member 28 for covering the frame 24 and the cord fixing block 26.

The frame 24 is made of synthetic resin such as polycarbonate resin by injection molding. The frame 24 comprises a receiver main body inserting portion 24A having an insertion space 24Aa into which the front portion of the receiver main body 18 is inserted from the rear side, and a block fitting portion 24B extending rearward from the receiver main body inserting portion 24A to be fitted with the cord fixing block 26. The frame 24 further comprises a pair of elastic engaging pieces 24C, formed by cutting part of left and right sides of the block fitting portion 24B, for elastically engaging with the rear end portion of the receiver main body 18 at the left and right sides. The frame 24 further comprises an outer tube portion 24D extending forward from a front end face 24Ab of the receiver main body inserting portion 24A.

The cord fixing block 26 is made of synthetic resin such as ABS resin by injection molding, and formed in the shape of a letter "U" in a side view so as to correspond to the shape of the block fitting portion 24B of the frame 24. An annular groove 26*a* is formed near the rear end of the cord fixing block 26. The cord 22 is inserted into the cord fixing block 26 through an insertion bore (not shown) formed at a lower part of the annular groove 26*a*, and an end of the cord 22 is connected to the terminal 18*b* of the receiver main body 18 via a substrate (not shown). A knot is made near the end of the cord 22 connected to the terminal 18*b* so that the knot hits the cord fixing block 26 when the cord 22 is pulled from outside, preventing a displacement of the cord 22.

The outer covering member 28 is made of soft material such as silicone rubber and is elastically deformed to some extent in state where it covers the frame 24 and the cord fixing block 26. The outer covering member 28 is cylindrical in shape before assembly, and annular flange portions 28*a*, 28*b* are formed at both axial ends thereof. The outer covering member 28 is fitted from the rear side over the frame 24 and the cord fixing block 26 by spreading out the annular flange portion 28*a*. In a fitted state, the annular flange portion 28*a* engages with a front end face 24Ab of the receiver main body inserting portion 24A of the frame 24, and the annular flange portion 28*b* engages with the annular groove 26*a* of the cord fixing block 26. The annular flange portion 28*b* is partly displaced forward so as to detour the cord 22 at the lower part of the annular groove 26*a*.

The outer tube portion 24D of the frame 24 has an annular flange portion 24Da projecting toward the outer circumference at a front end portion thereof, and a projection 24Dc projecting forward at a lower part of a front end face 24Db of the annular flange portion 24Da. An inner space 24Dd of the outer tube portion 24D communicates to the insertion space 24Aa of the receiver main body inserting portion 24A. A notch 24De is formed on a lower face at the rear end portion of the inner space 24Dd. This notch 24De prevents the sound release hole 18*a* from being clogged in state where the receiver main body 18 is inserted into the receiver main body inserting portion 24A. An inner tube member 30 is detachably inserted from the front side into the inner space 24Dd of the outer tube portion 24D. The outer tube portion 24D and the inner tube member 30 constinute the sound passage tube 16.

The inner tube member 30 is made of synthetic resin such as ABS resin by injection molding. The inner tube member 30 comprises a cylindrical portion 30A and a flange portion 30B formed on a front end portion of the cylindrical portion 30A to project toward the outer circumference. A through hole 30*a* formed in the center of the inner tube member 30 has a filter receiving portion 30*b* of large diameter at a front end thereof. The outer diameter of the cylindrical portion 30A at the region near the front end 30Aa is set to be substantially same as the inner diameter of the outer tube portion 24D. The outer diameter of the cylindrical portion 30A at the region which extends rearward from the region 30Aa, is set to be slightly smaller than the inner diameter of the outer tube portion 24D. The flange portion 30B has a notch 30Ba at its lower end and a chamfer 30Bb horizontally chamfered at its upper end.

The flange portion 30B comes into contact with the front end face 24Db of the outer tube portion 24D to axially position the inner tube member 30 when the inner tube member 30 is inserted into the outer tube portion 24D. The notch 30Ba engages with the projection 24Dc to circumferentially position the inner tube member 30 with respect to the outer tube portion 24D. The inner tube member 30 is slidably engaged with the outer tube portion 24D at the region near the front end 30Aa of the cylindrical portion 30A.

In state where the inner tube member 30 is inserted into the outer tube portion 24D, a sound passage 16*a* of the sound passage tube 16 is defined. The sound passage 16*a* is defined by the through hole 30*a* of the inner tube member 30 and the inner space 24Db of the outer tube portion 24D extending slightly from the rear side of the through hole 30*a*.

In the filter receiving portion 30*b* of the inner tube member 30, a disc-shaped acoustic filter 32 made of non-woven fabric is bonded by an adhesive or a double-faced tape.

The ear chip 14 is made of soft material such as silicone rubber. The ear chip 14 comprises a barrel portion 14A, and first and second annular flange portions 14B and 14C.

The barrel portion 14A defines a sound passage 14*a* communicating to the sound passage 16*a* when connected to the sound passage tube 16 of the receiver unit 12. The first annular flange portion 14B is the shape of a parabola spreading from the top end of the barrel portion 14A toward the middle thereof. The second annular flange portion 14C is the shape of a parabola spreading from the middle of the barrel portion 14A toward the base end thereof.

The first annular flange portion 14B has almost even thickness from its inner circumference to the outer circumference. The second annular flange portion 14C has greater thickness at the inner circumference, and has almost even thickness in the other regions of the entire periphery. The outer diameter of the first annular flange portion 14B is smaller than that of the second annular flange portion 14C. The first annular flange portion 14B has an inner circumference neighborhood 14Ba which is substantially formed in a sliced doughnut shape. The shape of a sliced doughnut is formed by rotating the shape of a circular arc at section taken along a plane containing the central axis Ax of the barrel portion 14*a*.

The material of the ear chip 14 has a Shore hardness A of 30 to 60 (e.g., 45). The thickness t1 of the first annular flange portion 14B is set at 0.3 mm to 0.6 mm (e.g., 0.5 mm). The thickness t2 of the second annular flange portion 14C is set at 0.3 mm to 0.6 mm (e.g., 0.5 mm) except for the thicker inner circumference. The outer diameter of the first annular flange portion 14B is set at about 10 mm, and the outer diameter of the second annular flange portion 14C is set at about 12 mm.

In a cross-section containing the central axis Ax of the barrel portion 14A, the radius of curvature R1 of an outer surface 14Ba1 of the inner circumference neighborhood 14Ba of the first annular flange portion 14B is set at 1.0 mm to 1.5 mm (e.g., 1.1 mm). The top end face 14Aa of the barrel portion 14A is positioned further back toward the base end of the barrel portion 14A than the outer surface 14Ba1 of the inner circumference neighborhood 14Ba. A connecting portion 14Aa1 formed in a circular arc smoothly connects the top end face 14Aa with the outer surface 14Ba1. Therefore, the inner circumference neighborhood 14Ba of the first annular flange portion 14B is substantially formed in a sliced doughnut shape. The radius of curvature R2 for this circular arc is set at 1.0 mm to 1.5 mm (e.g., 1.3 mm).

As above described, the insert earphone 10 has the ear chip 14 fitted to the sound passage tube 16 of the receiver unit 12, the ear chip comprises the barrel portion 14A defining the sound passage 14*a* communicating to the sound passage 16*a* of the sound passage tube 16, and the first and second annular flange portions 14B and 14C having the shape of a parabola spreading from the top end to the middle portion and from the middle portion to the base end of the barrel portion 14A respectively. The outer diameter of the first annular flange portion 14B is set to be smaller than that of the second annular flange portion 14C. The first annular flange portion has almost even thickness from the inner circumference to the outer circumference, with the inner circumference neighborhood 14Ba substantially formed in a sliced doughnut shape. This structure has the following advantages.

Figure 3:
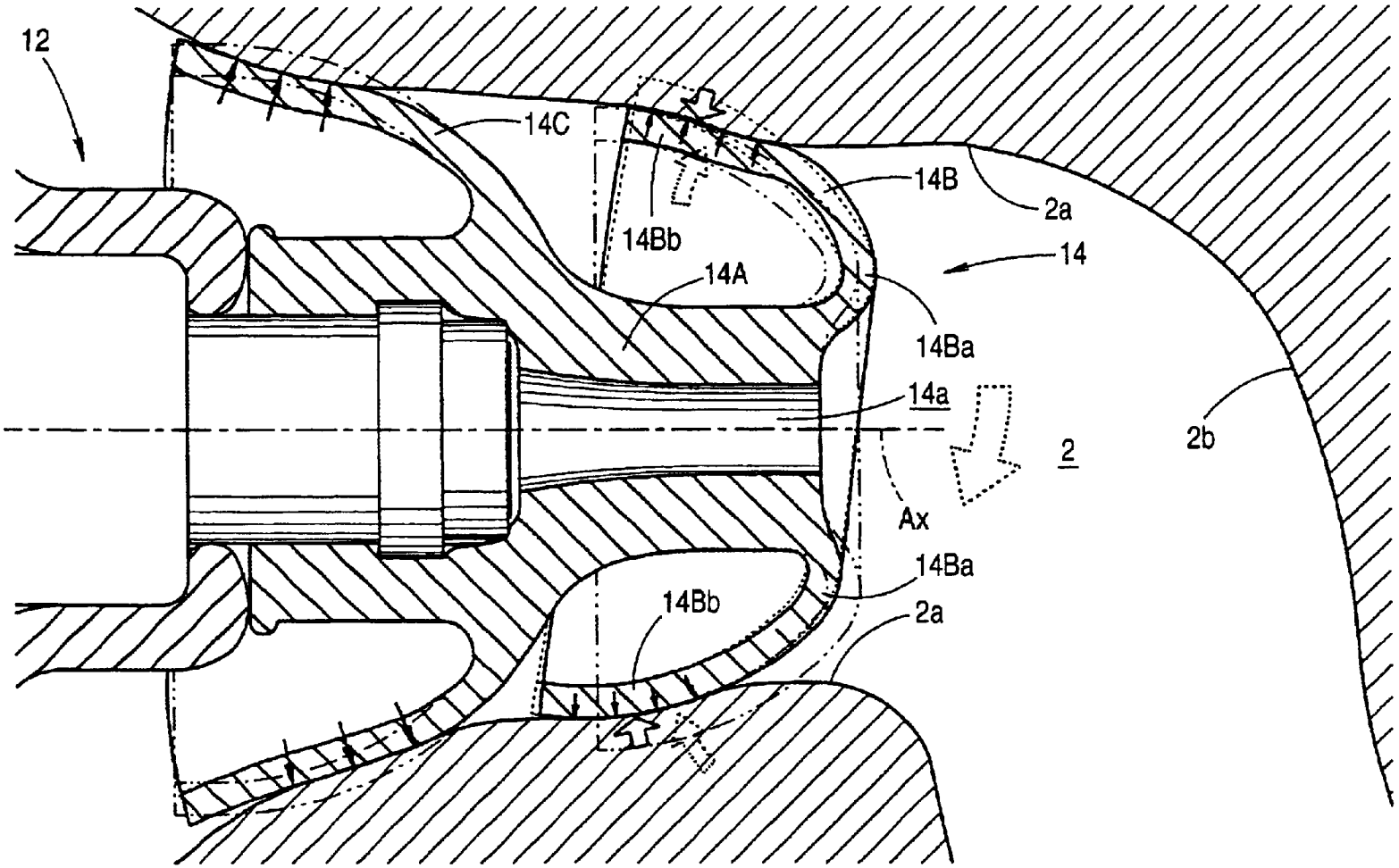
FIG. 3 is a partial side sectional view of the insert earphone being in use.
Figure 4:
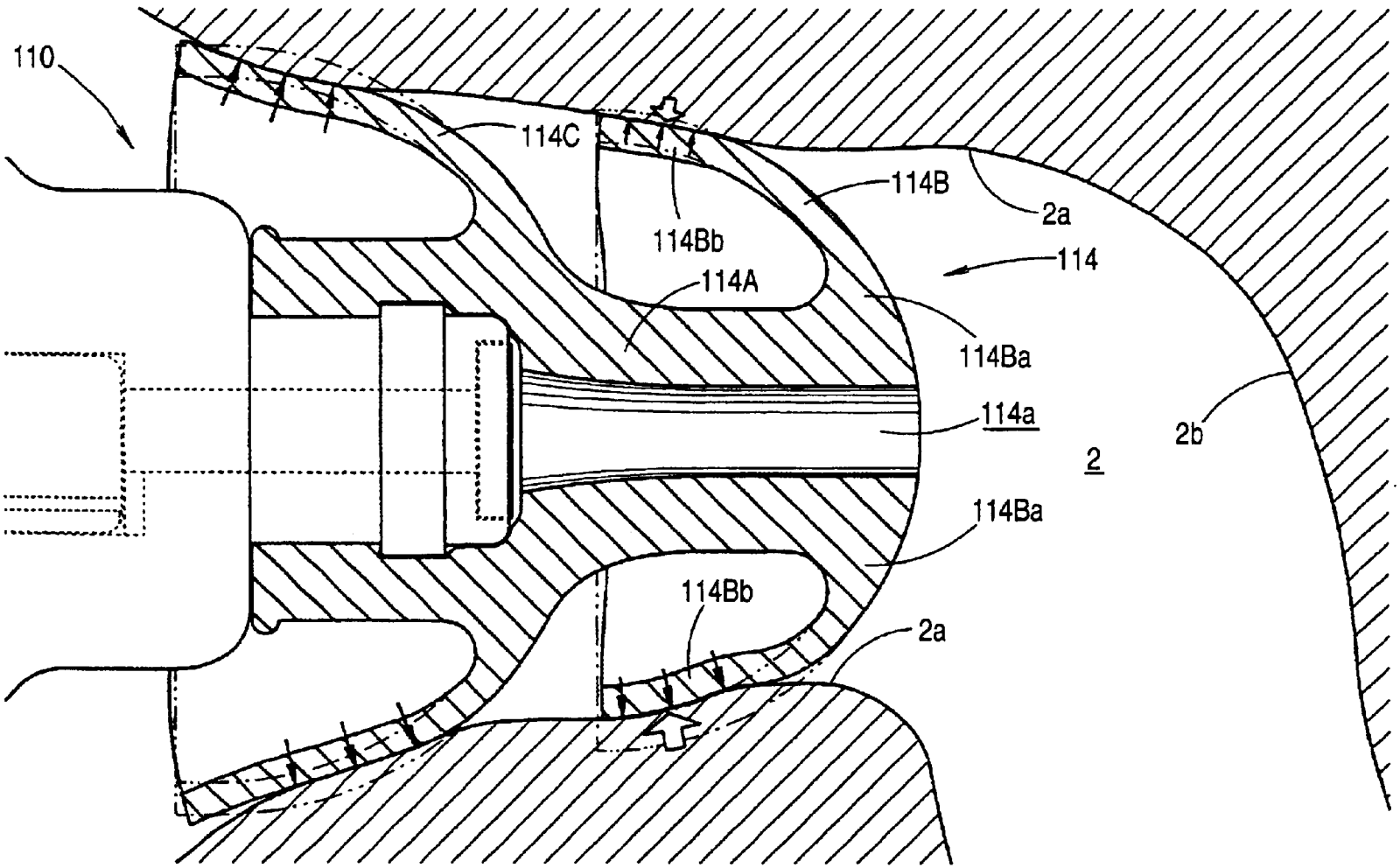
FIG. 4 is a partial side sectional view of a conventional insert earphone being in use.

When the ear chip 14 is inserted into the external auditory meatus 2 as shown in FIG. 3, the first annular flange portion 14B, particularly an outer circumference neighborhood 14Bb thereof is partially (for example, at its lower end portion in FIG. 3) brought into contact with the wall face 2*a* and receives a reaction force therefrom. Then, the inner circumference neighborhood 14Ba having a relatively smaller rigidity in the first annular flange portion 14B is firstly distorted. Since the inner circumference neighborhood 14Ba is substantially formed in a sliced doughnut shape, it is distorted by changing the radius of curvature for every circumferential part of the circular arc at cross section. Thereby, the outer circumference neighborhood 14Bb is rotated while the original shape thereof is substantially maintained (the shape shown by chain double-dashed line in FIG. 3). If there were no restriction, the outer circumference neighborhood 14Bb would be displaced to the position as indicated by the broken line in FIG. 3. However, the opposite side (upper end portion in FIG. 3) of the outer circumference neighborhood 14Bb, which is opposed to the side firstly hit against the wall face, hits the wall face 2*a* as the outer circumference neithborhood 14Bb is rotated, so that this opposite side is distorted to be pressed against the wall face 2*a*. If there is a difference in the pressing force against the wall face 2*a* for every part of the outer circumference neighborhood 14Bb, the pressing force is averaged due to a distortion of the inner circumference neighborhood 14Ba. Thereby, the first annular flange portion 14B is always in contact with the wall face 2*a* of the external auditory meatus 2 at a substantially uniform pressing force over the entire periphery.

Therefore, the first annular flange portion 14B is in closely and reliably contact with the wall face 2*a* of the external auditory meatus 2, effectively preventing a sound leakage. The outer circumference neighborhood 14Bb of the first annular flange portion 14B is in contact with the wall face 2*a* of the external auditory meatus 2 at substantially uniform pressing force over the entire periphery. It assures sufficient contacting function even if the pressing force is set at a small value. Accordingly, the first annular flange portion 14B does not partially strongly press the wall face 2*a* of the external auditory meatus 2, thereby increasing comfort while wearing the ear chip 14.

According to the insert earphone of the present invention, a sound leakage is effectively prevented and comfort in wearing the ear chip is increased.

Even when the user inserts the ear chip 14 into the depth region of the ear, the outer circumference neighborhood 14Bb of the first annular flange portion 14B is rotated to prevent the top end portion of the sound passage 14*a* of the ear chip 14 from being clogged by the first curved portion 2*b* in the external auditory meatus 2.

Since the first annular flange portion 14B is in closely contact with the wall face 2*a* of the external auditory meatus 2 to successfully prevent a sound leakage, the second annular flange portion 14C can be dedicated to the supporting function of the insert earphone 10. Specifically, the second annular flange portion 14C is fitted to the wall face 2*a* at an entrance region of the external auditory meatus 2 where the user unlikely feels unpleasant sensations in fitting the ear chip. The insert earphone 10 is supported surely, increasing the acoustic characteristics (especially in the low sound area).

In the above described embodiment, the thickness t2 of the second annular flange portion 14C except for the inner circumference is set at the same value as the thickness t1 of the first annular flange portion 14B. However, this thickness t2 may be set at a different value as needed.

In the above described embodiment, the connecting portion 14Aa1 formed in a circular arc smoothly connects the top end face 14Aa of the barrel portion 14A with the outer surface 14Ba1 of the inner circumference neighborhood 14Ba. Due to this structure, the first annular flange portion 14B has almost even thickness from the inner circumference to the outer circumference. The radius of curvature R2 for the connecting portion 14Aa1 has a value from 1.0 mm to 1.5 mm. Although the connecting portion 14Aa1 has such radius of curvature R2, the inner circumference neighborhood 14Ba is smoothly distorted when the outer circumference neighborhood 14Bb is subject to a reaction force from the wall face 2*a*. Such connecting portion 14Aa1 prevents a crack at the inner circumference of the first annular flange portion 14B when the inner circumference neighborhood 14Ba is distorted.

Further, the thickness t1 of the first annular flange portion 14B is set at 0.3 mm to 0.6 mm. This enables the outer circumference neighborhood 14Bb to maintain the the original shape thereof in rotation, owing to distortion of the inner circumference neighborhood 14Ba. Also, this enables a reduction in thickness of the first annular flange portion 14B.

Further, since the radius of curvature R1 for the outer surface 14Ba1 of the inner circumference neighborhood 14Ba of the first annular flange portion 14B is set at 1.0 to 1.5 mm, maintenance of the original shape of the outer circumference neighborhood 14Bb in rotation is easily available owing to distortion of the inner circumference neighborhood 14Ba.

What is claimed is:

1. An insert earphone adapted to be inserted into an external auditory meatus comprising:

a receiver unit having a sound passage tube;

an ear chip attached to the receiver unit and comprising a barrel portion for defining a sound passage communicating to a sound passage of the sound passage tube of the receiver unit, a first annular flange portion having the shape of a parabola spreading from the top end of the barrel portion toward the middle thereof, the first annular flange portion forming a top end of the ear chip, and a second annular flange portion having the shape of a parabola spreading from the middle of the barrel portion toward a base end thereof; and the first annular flange portion having a smaller outer diameter compared with the second annular flange portion, wherein the first annular flange portion has almost even thickness from the inner circumference thereof to the outer circumference thereof, and the first annular flange portion has an inner circumference neighborhood substantially formed in the shape of a sliced doughnut, a top end face of the barrel portion is positioned closer to the base end side than is the inner circumference neighborhood, and the inner circumference neighborhood has a smooth circular arc portion.

2. The insert earphone as claimed in claim 1, wherein the thickness of the first annular flange portion is not less than 0.3 mm and not more than 0.6 mm.

3. The insert earphone as claimed in claim 1, wherein the inner circumference neighborhood of the first annular flange portion has an outer surface whose radius of curvature is not less than 1.0 mm and not more than 1.5 mm.

4. The insert earphone as claimed in claim 2, wherein the inner circumference neighborhood of the first annular flange portion has an outer surface whose radius of curvature is not less than 1.0 mm and not more than 1.5 mm.

* * * * *